United States Patent [19]

Mitard et al.

[11] 4,444,116

[45] Apr. 24, 1984

[54] MISSILE SUCH AS HAND GRENADE, NOTABLY FOR ANTITANK FIGHTING

[75] Inventors: Luc Mitard, St Denis de Palin; Claude Cabanel, St Florent sur Cher, both of France

[73] Assignee: Luchaire S.A., Paris, France

[21] Appl. No.: 379,993

[22] Filed: May 19, 1982

[30] Foreign Application Priority Data

Jun. 26, 1981 [FR] France ..... 81 12684

[51] Int. Cl.[3] ..... F42B 27/02

[52] U.S. Cl. ..... 102/476; 102/482; 102/488; 102/481

[58] Field of Search ..... 102/482, 486, 488, 475, 102/476, 492, 384, 481, 484, 500; 244/3.28

[56] References Cited

U.S. PATENT DOCUMENTS

| | | | |
|---|---|---|---|
| 1,296,403 | 3/1919 | Kindle | 244/3.28 |
| 2,412,967 | 12/1946 | Church et al. | 102/475 |
| 3,855,933 | 12/1974 | Messineo | 102/476 |
| 3,913,483 | 10/1975 | Wolterman | 102/476 |
| 4,023,499 | 5/1977 | Chavee | 102/488 |
| 4,160,414 | 7/1979 | Stockman et al. | 102/488 |

FOREIGN PATENT DOCUMENTS

| | | | |
|---|---|---|---|
| 2422136 | 11/1979 | France | 102/476 |
| 319270 | 2/1957 | Switzerland | 102/476 |

*Primary Examiner*—Charles T. Jordan
*Assistant Examiner*—Ted L. Parr
*Attorney, Agent, or Firm*—Wenderoth, Lind & Ponack

[57] ABSTRACT

This hand grenade comprises a timer for preserving the user's safety when throwing the missile by breaking the pyrotechnic train of the fuse a stabilizing system utilizing the concurrent effects of a weighted ogive and a spread-out empennage adapted when released and operative to brake the missile by aerodynamic effect, thus improving the efficiency of the missile when striking with a low incidence a horizontal surface such as the roof of an armored vehicle. The fins of the empennage are released when removing a safety pin, thus causing the missile to be stabilized in a substantially vertical axial position.

5 Claims, 2 Drawing Figures

MISSILE SUCH AS HAND GRENADE, NOTABLY FOR ANTITANK FIGHTING

BACKGROUND OF THE INVENTION

This invention relates to missiles in general and has specific reference to a hand grenade designed for enabling troops to attack armored vehicles and tanks, and effective more particularly for street-fighting.

The grenade according to the present invention is intended more specifically for attacking vehicles and tanks of the aforesaid type from above or through the roof. Therefore, a hand grenade of this type should be capable when thrown to rapidly become self-stabilizing and thus fall vertically and fire when hitting the roof of the vehicle. Moreover, the storae and throwing safety must be preserved under all circumstances.

These various requirements are fully met by the present invention.

SUMMARY OF THE INVENTION

According to the invention, the hand grenade comprises not only timing means or a delay fuse for obvious safety reasons, so as to break the pyrotechnical train of the fuse incorporated in the grenade, but also stabilizing means exploiting the concurrent effects of a weighted ogive and a spread-out empennage producing a breaking action by aerodynamic effect. With this stabilization it is thus possible to improve the efficiency of the missle striking under low-incidence conditions a substantially horizontal surface, for example the roof of an armored vehicle or a tank.

BRIEF DESCRIPTION OF THE DRAWINGS

The various characteristic features and advantages of the present invention will appear more clearly from the following description, with reference to the accompanying drawings, wherein.

DESCRIPTION OF THE PREFERRED EMBODIMENT

Figure 1:
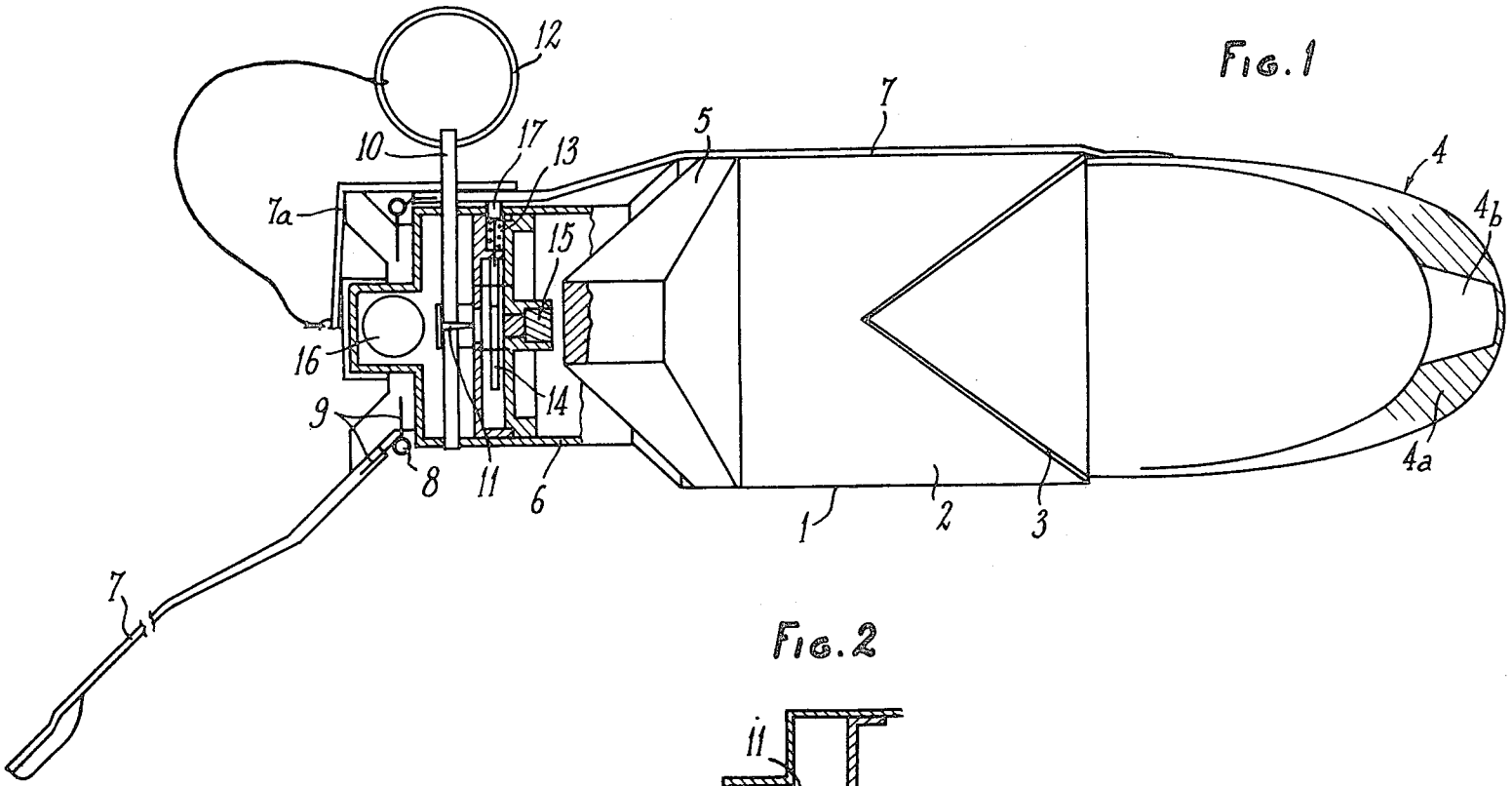
FIG. 1 is a longitudinal axial section showing an embodiment of a hand grenade according to the instant invention.
Figure 2:
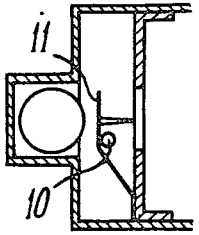
FIG. 2 is a section illustrating the locking system associated with a striker of the hand granade of FIG. 1.

The grenade body comprises essentially a casing 1 containing a hollow charge 2 and a lining 3. This body is connected at one end to an give or ogive-shaped nosepiece 4 and at the opposite end to a fuse 5 through fuse casing 6 shown only diagrammatically.

According to a specific feature characterizing this invention, the ogive 4 is weighted by means of a suitable material contained in a chamber 4*a* at the forward end of ogive 4. This material is selected among those not likely to interfer with the jet of the hollow charge, and this also applies, for the same reason, to the ogive forming material and the inner wall thereof. In the example illustrated the chamber 4*a* containing the weight material has an axial recess 4*b* of which the shape and dimensions are selected with a view to avoid any interference with the jet formed by the hollow charge 2.

The weighted ogive has a two fold function: in addition to providing the desired efficiency of the missile at the selected throwing distance, it sets the particular position of the centre of gravity of the grenade which promotes a proper self-stabilization of the grenade itself.

Also according to this invention, the grenade is provided with a spread-out empennage of which the fins 7 are pivotally mounted at 8 to the fuse casing 6 and urged by suitable spring means 9 to their operative position. All the fins open simultaneously under the control of a conventional system (not shown). When stored the fins 7 are locked in their folded position along the body 1 by a cap 7*a* locked in turn by a safety pin 10 also acting as the grenade safety pin normally locking the fuse striker 11. This safety pin 10 includes in the known fashion a control ring 12 connected to the cap 7*a*.

Finally, the grenade according to the instant invention is provided with safety means adapted to break the pyrotechnic train by means of a timer or delay 13 adapted to rotatably drive an inertia shutter 14 disposed between the fuse detonator 15 and the fuse striker 11 hit by a ball 16 upon impact of the grenade.

The fuse timer is normally retained by a lock bolt 17 reacting against one of the empennage fins 7. When these fins are allowed to spread out, this lock bolt 17 is ejected, this movement being facilitated by spring means so as to release the timer. The timer operation is attended by the retraction of shutter 14, whereby the pyrotechnic train is aligned after a predetermined time lag.

The above-described embodiment of the hand grenade according to the present invention operates as follows.

The grenade is held in the hand at the level of the body 1 so as to firmly and safely grip the fins 7.

Before throwing the grenade, the safety pin 10 is removed and thus carries along the fin holding cap 7*a*.

Under these conditions, if the grenade is ready for launching, it is still possible to neutralize it. Thus, if it is desired for any reason to store the grenade away for a later use, it is only necessary to refit the fin holding cap 7*a* and the safety pin 10.

Otherwise, throwing the grenade is attended by the spreading out of the fins and this movement causes the timer to be released and to release in turn its locking pin. The fuse is thus set after a predetermined time-lag depending on the timer operation, this time-lag corresponding to the desired safety throwing distance.

Considering the combination of the aerodynamic drag produced by the fins with the effect of gravity enforced by the ogive weighing, the grenade will stabilize itself very rapidly with limited movements of rotation and nutation, thus positioning the longitudinal axis of the grenade in a vertical direction during the downward travel of the grenade.

In the example described and illustrated herein, an antitank hand grenade is contemplated. Of course, the present invention should not be constructed as being strictly limited to this specific type of missile, since it is applicable to any other types of missiles to be thrown by hand.

We claim:

1. In a missile adapted to be thrown by hand, such as a hand grenade, said missile being of the type including a casing having opposite forward and rear ends, and a hollow charge within said casing and adapted upon detonation to form an explosive jet through said forward end of said casing, the improvement of means for rapidly stabilizing the trajectory of said missile after launching thereof such that said missile is capable of descending in a vertical position with said forward end down, said means comprising:

spreadable empannage means, attached adjacent said rear end of said casing and operable upon launch of said missile to spread outwardly from said casing, to aerodynamically stabilize said missile;

an ogive-shaped nosepiece attached to said forward end of said casing;

weight means in said nosepiece for additionally stabilizing vertical downward flight of said missile with said nosepiece positioned downwardly; and said weight means having means for preventing interference with the explosive jet of said hollow charge upon detonation, said preventing means comprising a recess formed in said weight means and having a shape and dimensions to enable the explosive jet to pass therethrough.

2. The improvement claimed in claim 1, wherein said weight means comprises weighted material positioned at a forward end of said nosepiece.

3. The improvement claimed in claim 2, wherein said recess is formed in said weighted material at a position aligned with the longitudinal axis of said casing.

4. The improvement claimed in claim 1, wherein said empannage means comprises plural fins pivotally mounted adjacent said rear end of said casing, cap means for holding said fins in a forwardly folded inoperative position, and a safety pin locking said cap means in a position holding said fins in said inoperative position thereof, said missile further including a fuse and a detonator for detonating said hollow charge, and a striker for detonating said fuse upon impact of said missile, and said safety pin maintains said striker spaced from said detonator when said fins are in said inoperative position thereof.

5. The improvement claimed in claim 4, further comprising safety means for, upon removal of said safety pin and said cap means and launching of said missile, preventing detonation for a predetermined safety period, said means comprising a shutter mounted for movement between said striker and said detonator, and delay means for delayed movement of said shutter to a position whereat said striker may impact against said detonator.

* * * * *